US008377238B2

(12) United States Patent
Wozniak et al.

(10) Patent No.: US 8,377,238 B2
(45) Date of Patent: Feb. 19, 2013

(54) METHOD FOR THE THERMOMECHANICAL TREATMENT OF SEAMLESS RINGS PRODUCED ON RADIAL-AXIAL RING ROLLING MACHINES

(75) Inventors: Johannes Wozniak, Lippstadt (DE); Axel von Hehl, Essen (DE); Nikolaus Balmus, Dortmund (DE); Daniel Hansmann, Gelsenkirchen (DE)

(73) Assignee: Rothe Erde GmbH, Dortmund (DE)

( * ) Notice: Subject to any disclaimer, the term of this patent is extended or adjusted under 35 U.S.C. 154(b) by 698 days.

(21) Appl. No.: 12/442,772

(22) PCT Filed: Aug. 23, 2007

(86) PCT No.: PCT/EP2007/007400

§ 371 (c)(1),
(2), (4) Date: Mar. 25, 2009

(87) PCT Pub. No.: WO2008/037327

PCT Pub. Date: Apr. 3, 2008

(65) Prior Publication Data

US 2010/0024929 A1 Feb. 4, 2010

(30) Foreign Application Priority Data

Sep. 28, 2006 (DE) ..... 10 2006 045 871

(51) Int. Cl.
*C21D 9/40* (2006.01)

(52) U.S. Cl. ..... 148/589; 148/547

(58) Field of Classification Search ..... 148/589, 148/545, 547, 548

See application file for complete search history.

(56) References Cited

U.S. PATENT DOCUMENTS 6,585,834 B1 * 7/2003 Kapaan et al. ..... 148/589

FOREIGN PATENT DOCUMENTS

| | | |
|---|---|---|
| CN | 1229013 A | 9/1999 |
| CN | 1262709 A | 8/2000 |
| DE | 1 964 795 | 7/1971 |
| DE | 33 14 847 Al | 10/1984 |
| EP | 0 413 163 Al | 2/1991 |
| EP | 0 586 179 Al | 3/1994 |

(Continued)

*Primary Examiner* — Roy King
*Assistant Examiner* — Janelle Morillo
(74) *Attorney, Agent, or Firm* — McGlew and Tuttle, P.C.

(57) ABSTRACT

A method and a device are provided for the thermomechanical treatment of seamless steel rings produced on radial-axial ring rolling machines, particularly rings of fine grain steel, heat-treatable steel, case hardened steel, or austenitic steel, preferably of steel tower flanges for wind turbine generators. The ring blank is inserted into the ring rolling machine at a temperature in the range of 900° C. to 1150° C. and is rolled to an outer diameter preferably in the range of 0.2 m to 10 m by a hot forming process. The hot ring (1) is quickly cooled down by a controlled process directly following the rolling, without secondary heating, from a temperature over the conversion temperature in the austenite range to a temperature below 400° C. The device includes a dipping basin filled with cooling liquid (8) or an unfilled cooling container, and a carrier (5) that can be lowered with a hoisting device (4), the rolled ring (1) lying on the carrier. Pressure nozzles (13) are arranged in the dipping basin or the cooling container (2) on one or several ring lines (11), in an equal distribution, for the targeted application of the cooling liquid (8) onto at least one of the ring-shaped surfaces of the ring (1). Measurement of the ring temperature before and/or after the cooldown is carried out, preferably, with a radiation pyrometer.

15 Claims, 2 Drawing Sheets

FOREIGN PATENT DOCUMENTS

| | | |
|---|---|---|
| EP | 0 943 694 | 9/1999 |
| EP | 1 215 291 Al | 6/2002 |
| KR | 100 566 118 B1 | 3/2006 |
| NL | WO 99/02744 | 1/1999 |

* cited by examiner

METHOD FOR THE THERMOMECHANICAL TREATMENT OF SEAMLESS RINGS PRODUCED ON RADIAL-AXIAL RING ROLLING MACHINES

CROSS REFERENCE TO RELATED APPLICATIONS

This application is a United States National Phase application of International Application PCT/EP007/007400 and claims the benefit of priority under 35 U.S.C. §119 of German Patent Application DE 10 2006 045 871.0 filed Sep. 28, 2006, the entire contents of which are incorporated herein by reference.

FIELD OF THE INVENTION

The present invention pertains to a method for the thermomechanical treatment of seamless rings produced on radial-axial ring rolling machines and to a device for the cooling of hot formed rings to implement the method.

BACKGROUND OF THE INVENTION

On production of seamless rings on radial-axial ring rolling machines, the ring blanks are usually inserted into the ring rolling machine at a temperature of 900 to 1200° C. and rolled to an outer diameter of preferably 0.2 to 10 m. After rolling, the rings are usually stored intermediately and mostly cooled down to ambient temperature. Within the scope of the subsequent heat treatment it is then required to heat-up the ring again up to a temperature in the austenite range and from there on to cool it down to produce a fine-grained and even fabric. The additional heat treatment involves high expenditure and substantial demand for energy.

Known from EP 413 163 B1 is a method and a device for the production of thermomechanically treated rolling material made of steel, wherein the transformation of the rolling material is carried out in a range of temperature between ambient temperature and a temperature of 930° C., and wherein an accelerated cooling of the rolling material is implemented by the aid of cooling media such as water, air or a mixture of water and air in a cooling facility located downstream in order to improve material properties. This method is provided only for the production of flat and long products as well as rolling wire. The precise way of cooling is not described therein.

Moreover, in the Korean description KR 1005661118 B1, a ring rolling method including a subsequent heating-up of the rolled ring in a kiln and the cooling-down of the ring in a dipping basin are disclosed, wherein the diameter of the rings should range between 4,500 and 9,300 mm while the height is to be within 300 and 280 mm. Here, too, the energy-demanding renewed warming-up of the ring prior to the final immersion cooling is described therein.

The German publication DE 33 14 847 A1 describes a method for the fabrication of seamless rings with improved resilience properties by applying a hot forming process followed by a heat treatment process. Such spring steels must have quite specific properties and are subjected to certain multiple-stage treatments. The procedures are relatively complicated.

Moreover, German publication DE 1 964 795 B discloses a method for the heat treatment of steels immediately from the heat of deformation including an accelerated cooling-down, also implementing a two-stage cooling-down in the way that initially the hot formed material is cooled from a deformation final temperature of 880°-950° with a cooling-down speed of 50°-25° per second down to a temperature which lies 40° 10° above the AI-point, i.e. roughly at 710°-740°. This temperature is then to be maintained for 1 to 20 minutes. Subsequently, the material is cooled down speedily to under the martensite point, i.e. to a temperature of under approx. 320° C.

SUMMARY OF THE INVENTION

It is the object of the present invention to reduce in particular the expenditure and consumption of energy during the production of rolled seamless rings with a fine-grain and even fabric.

The inventive method provides for cooling the hot ring immediately after rolling without a secondary heating preferably in a dipping basin or an unfilled cooling container quickly from a temperature scarcely above the conversion temperature in the austenite range in a controlled manner down to a defined temperature. While refraining from any additional heat treatment and utilizing the rolling heat for the fabric conversion, process steps are reduced and substantial savings in energy required for a usual heat treatment are achieved. It has become evident that a sufficiently even and fine-grain fabric can be obtained after cooling and/or quenching even without this additional heat treatment, provided that certain cooling parameters are fulfilled and that a precisely defined dipping and/or cooling time is met. To be able to meet these precise parameters, the present invention provides for measuring the temperature of the ring before and/or after the cooldown, preferably directly before the dipping basin and/or cooling container, applying a radiation pyrometer, while the dipping time and/or cooling time is adjusted preferably depending on the temperature of the ring and cooling liquid measured before dipping and/or cooling. By monitoring the temperature of the ring before the dipping and/or cooling procedure, it can in particular be prevented that the ring is dipped-in and/or cooled at too low a temperature which lies below the conversion temperature. To cope with this case, the ring is initially heated-up again to the required temperature.

To achieve a sufficiently quick cooldown and/or quenching of the ring in the dipping basin or cooling container, the invention furthermore proposes to charge the ring with a cooling liquid, preferably water, at an elevated pressure trough nozzles equally distributed along the ring periphery. The cooling liquid charged at a certain pressure can be precisely adjusted locally and/or in terms of quantity; it depends on the individual dimensions (diameter, thickness, and cross-sectional shape) of the rolled ring. In case of demand, even several dipping or cooling procedures can be executed consecutively, it also being possible to move the ring to be cooled by turning, lifting and lowering it during the dipping or cooling procedure.

The device for cooling the hot formed rings is comprised of a dipping basin filled with a cooling liquid or an unfilled cooling container, a carrier that can be lowered with a hoisting device and, according to the present invention, of pressure nozzles equally distributed in the dipping basin or cooling container at one or several ring lines for a targeted application of the cooling liquid on at least one of the ring-shaped surfaces of the ring. For example, by way of the pressure nozzles designed as twisting nozzles, it is possible to achieve a highly targeted cooling at the surface of the ring so that the fine-grain anstenite fabric is transformed into the conversion fabric desired in the component function zone later-on. Owing to the high impact speeds of the cooling liquid, the insulating vapor film which may develop due to the Leidenfrost phenomenon at the beginning of the cooldown and which may drastically reduce the heat transfer is largely destroyed, especially if water is applied as cooling liquid. As a result, the cooldown velocity is already maximized at the beginning of the cooling process, it means still at high ring temperatures. It has turned out to be favorable to provide severally concentrically arranged ring lines with equally distributed pressure nozzles at the bottom of the dipping basin or cooling container, with the diameter of the ring lines essentially corresponding to the diameter of the rings to be cooled.

Accordingly, each ring line can be controlled separately so that rings having the most different diameters, thicknesses and heights can be cooled in a well-aimed approach. The volumetric streams can also be regulated in order to suitably adapt the impact velocities, too. As soon as the ring temperature has sunk far enough so that the phase of film evaporation has been passed as the phase of the quenching-intensive bubble boiling commences, the on-streaming phase can be reduced. Within the temperature range of the convection phase, the convective heat transfer can be supported by the aid of a spraying on the one hand and on the other hand, the temperature of the ring surface is also harmonized apart from the water bath temperature. For the dipping or cooling procedure, the rolled ring can also be deposited on a carrier composed of radially extending ledges or a grating. To measure the temperature of the hot ring lying on the carrier, a radiation pyrometer is mounted immediately above the cooling liquid at the level of the carrier. The dipping or cooling basin can be configured as a round and/or ring-shaped basin, especially to suit the geometry of the rolled rings.

The invention is elucidated by way of the attached figures, taking these as examples. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
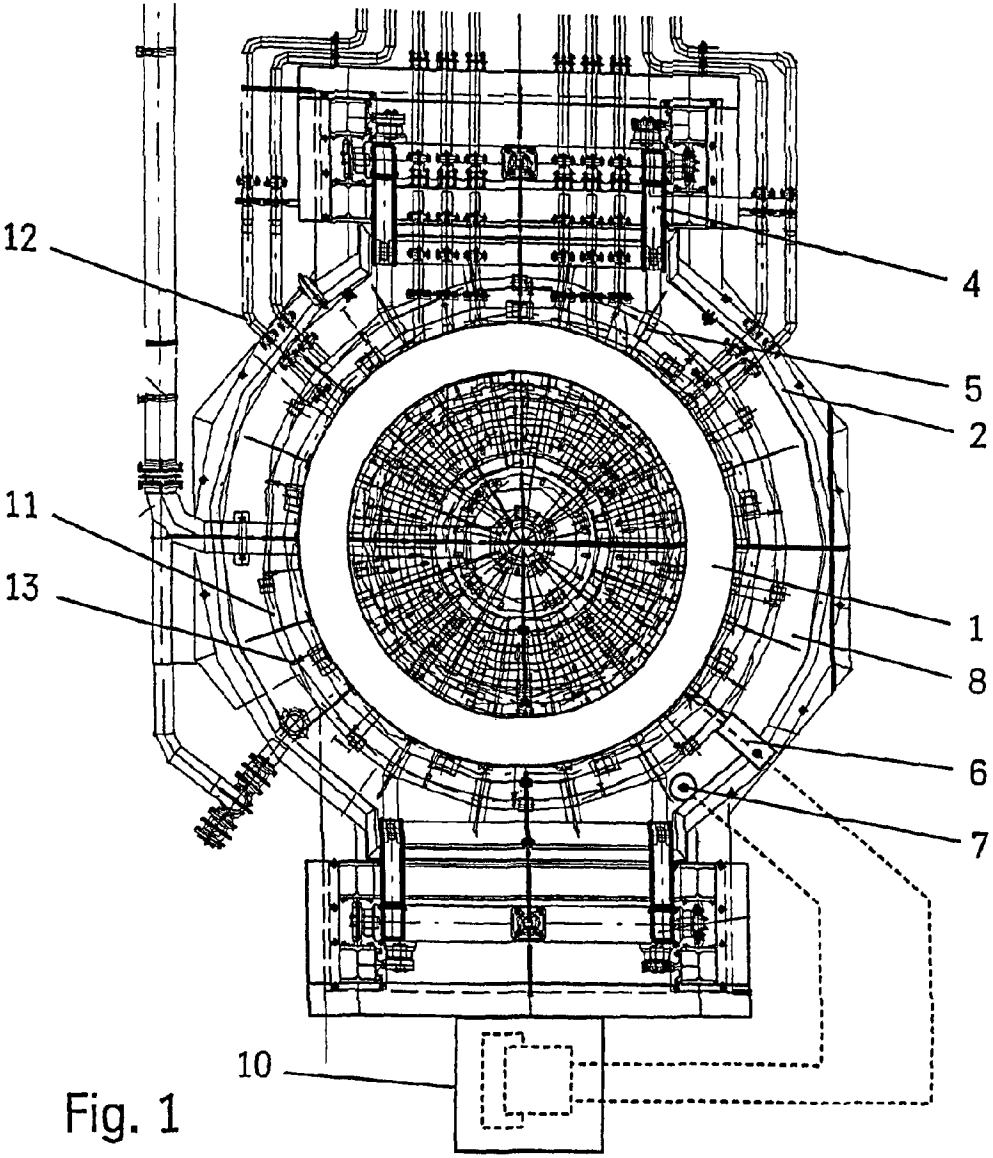
FIG. 1 is a top view on the inventive dipping basin.

Referring to the drawings in particular, the hot ring 1 produced in the radial-axial ring rolling machine not shown here is deposited by means of a crane 3 onto carrier 5 of the hoisting device 4. In this take-up position, the carrier 5 is located directly above the surface of the cooling liquid 8 of dipping basin 2. Having measured the temperature of the hot ring 1 by the aid of radiation pyrometer 6 and having determined the temperature of the cooling liquid 8 by the aid of temperature measuring device 7, the design dipping time is determined via an algorithm in the control unit 10 together with the ring geometry and the conversion temperature to be achieved. The hot ring 1 lying on carrier 5 is directly next immersed by means of hoisting device 4 into dipping basin 2 and kept in dipping basin 2 until the calculated design dipping time has been reached. Subsequently, ring 1 is again lifted from dipping basin 2 and the ring temperature is again measured, using radiation pyrometer 6. If required, the dipping procedure can be repeated. This may be required especially for rings 1 made of steel grades having higher alloy content and thus worse thermal conductivity, though it thereby is inerter in conversion, too. It has turned out to be purposive to keep ring 1 outside dipping basin 2 after each emerging so as to reduce the temperature gradient between the rim and core of ring 1 due to the heat after-flowing from the ring core. In particular, the surface temperature can be continuously measured and when reaching a defined maximum temperature the dipping procedure can be repeated. Applying this cyclical mode of operation, the chronological difference in the fabric transformation between the rim area and the core of ring 1 and thus the fabric difference between the rim and core is reduced. Moreover, the risk of tearing apart due to inner strains and stresses is by and large prevented.

To improve the quenching process, a series of ring lines 11 with pressure nozzles equally spread at the periphery are arranged concentrically to each other at the bottom of the dipping basin 2. At the beginning of the dipping process, a cooling liquid 8 is selectively applied by the aid of these pressure nozzles 13 at the highest possible pressure onto the ring-shaped surfaces of ring 1.

Especially when water is used as cooling liquid, the cooling procedure can thereby be speeded-up because the so-called "Leidenfrost effect" which may generate a certain insulating effect at the ring surface, leading to a strong reduction of the discharged amount of heat does not occur. The individual ring lines 11 are connected through their own supply lines 12 and shutoff valves with the outer pump system not shown here. Thereby it is possible to charge only the ring line 11 with the corresponding pressure nozzles 13 which roughly have the same diameter as the deposited ring 1. On each ring line 11, the pressure nozzles are so arranged that the can supply cooling liquid to the lower ring area on the one hand and on the other hand at least to the two vertical inner and outer ring areas.

Figure 2:
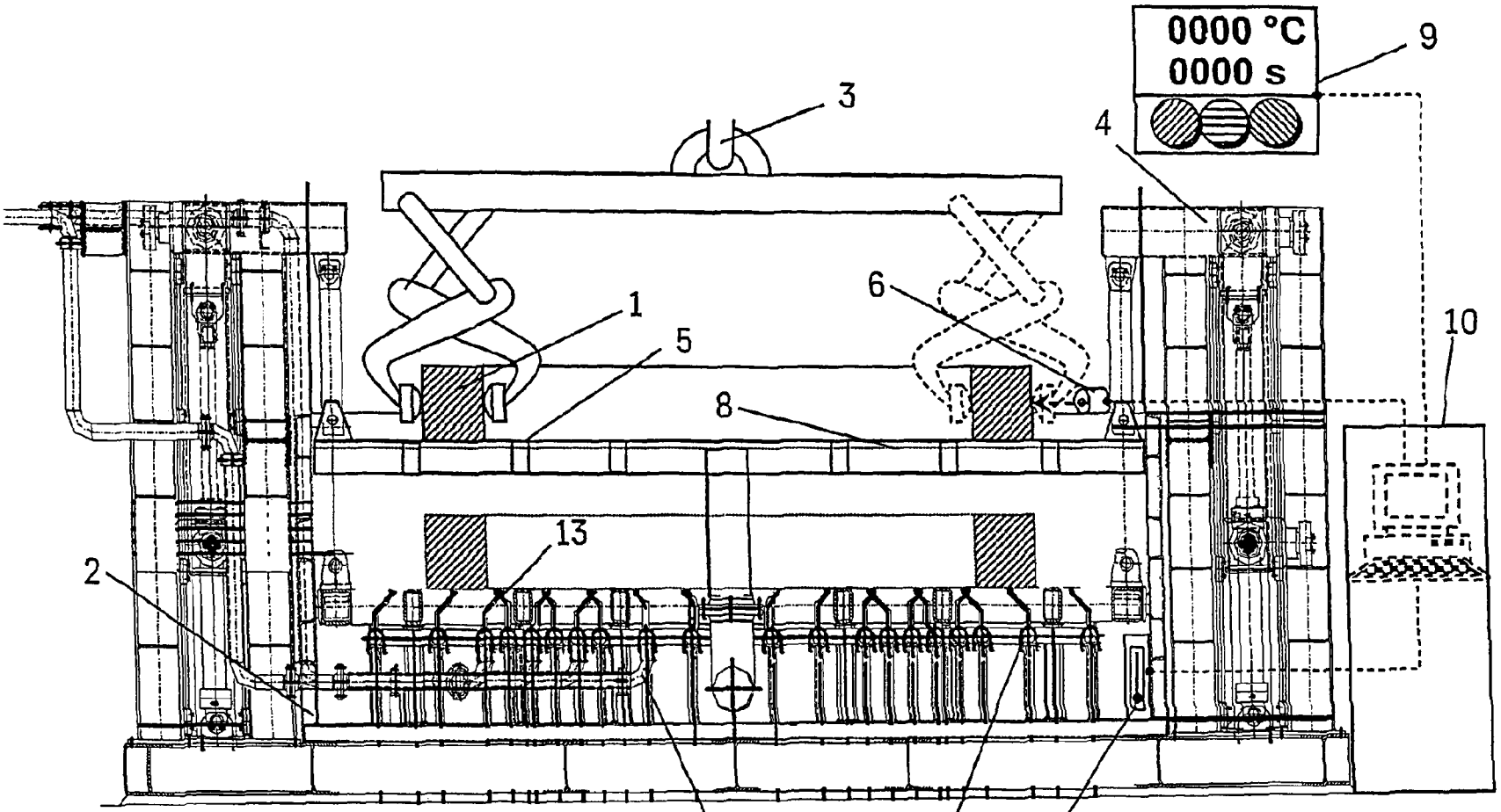
FIG. 2 is a vertical sectional view taken through the dipping basin 2 as per FIG. 1 with the schematic arrangement of the inventive plant.

FIG. 2 additionally shows a schematic view of a display unit 9 which indicates the temperature of ring 1 measured by the radiation pyrometer 6 on the one hand and on the other hand displaying the dipping time pre-defined in control unit 10 in seconds. In addition, display unit 9 is comprised of au actually known traffic light unit giving release to the plant operator once the light is on green to initiate the dipping procedure or to prohibit the dipping procedure once the light is on red, for example because the temperature of the ring has already become too low or because the plant is affected by a fault. A yellow signal indicates the operator that the plant is ready to operate.

While specific embodiments of the invention have been shown and described in detail to illustrate the application of the principles of the invention, it will be understood that the invention may be embodied otherwise without departing from such principles.

The invention claimed is:

1. A method for the thermomechanical treatment of seamless steel rings produced on radial-axial rolling machines, the seamless steel rings including rings of fine grain steel, heat-treatable steel, case hardened steel, or austenitic steel, the method comprising the steps of:

inserting a ring blank into the ring rolling machine at a temperature in the range of 900° C. to 1150° C.;

rolling the ring to an outer diameter in the range of 0.2 m to 10 m by a hot forming process;

quickly cooling down the hot ring in a dipping basin by a controlled cooldown process directly following the rolling, without secondary heating, from a temperature over the conversion temperature in the austenite range to a temperature below 400° C., said dipping basin being filled with a cooling liquid, said ring being subsequently cooled at air down to ambient temperature, the temperature of said ring being measured with a radiation pyrometer before and/or after cooling, wherein the cooling time is adjusted depending on the temperature of the ring and cooling liquid measured before the dipping process, said ring being immersed in the cooling liquid of said dipping basin, wherein said ring engages the cooling liquid provided in said dipping basin, said ring in the filled dipping basin being charged with the cooling liquid at elevated pressure via nozzles distributed uniformly along a circumference of said ring, wherein a plurality of dipping operations are carried out one after another.

2. A method as defined in claim 1, wherein the ring to be cooled is moved about a vertical central axis and/or oscillated up and down during the dipping and/or cooling procedure.

3. A method as defined in claim 1, wherein the rings form steel tower flanges for wind turbine generators.

4. A method for the thermomechanical treatment of seamless steel rings produced on radial-axial rolling machines, the method comprising the steps of:

providing a dipping basin filled with cooling liquid for cooling a ring, the dipping basing having pressure nozzles arranged in the dipping basin on one or several ring lines in an equal or substantially equal distribution for the targeted application of cooling liquid onto at least one of ring-shaped surfaces of the ring;

providing a carrier that can be lowered with a hoisting device with a rolled ring lying on the carrier;

inserting a ring blank into the ring rolling machine at a temperature in the range of 900° C. to 1150° C.;

rolling the ring to an outer diameter by a hot forming process;

quickly cooling down the hot ring in a dipping basin by a controlled cooldown process directly following the rolling, without secondary heating, from a temperature over the conversion temperature in the austenite range to a temperature below 400° C., wherein the ring engages the cooling liquid in the filled dipping basin and the ring is charged with cooling liquid at elevated pressure through nozzles equally spread along the ring circumference, wherein said ring is surrounded by the cooling liquid in said dipping basin, wherein:

the ring is subsequently cooled at air down to ambient temperature;

the temperature of the ring is measured with a radiation pyrometer before and/or after cooldown process;

the cooling time is adjusted depending on the temperature of the ring and cooling liquid measured before the dipping or cooldown process; and several dipping and/or cooling procedures are carried out consecutively.

5. A method as defined in claim 4, wherein the pressurized cooling liquid is adjusted as to one or more of location of application and quantity of liquid coolant flowing per time.

6. A method as defined in claim 4, wherein the ring is rolled to an outer diameter in the range of 0.2 m to 10 m by a hot forming process.

7. A method as defined in claim 4, wherein said dipping basin comprises a reservoir of the cooling liquid.

8. A method as defined in claim 4, wherein said nozzles provide an increased pressure flow of cooling liquid in a direction of said ring, wherein said increased pressure flow of cooling liquid engages a surface of said ring.

9. A method as defined in claim 1, wherein said dipping basin comprises a reservoir of the cooling liquid.

10. A method as defined in claim 1, wherein said nozzles provide an increased pressure flow of cooling liquid in a direction of said ring, wherein said increased pressure flow of cooling liquid engages a surface of said ring.

11. A method for the thermomechanical treatment of seamless steel rings produced on radial-axial rolling machines, the method comprising the steps of:

providing a structure comprising a reservoir of cooling liquid;

providing a plurality of pressure nozzles arranged in the structure on one or several ring lines in an equal or substantially equal distribution for a targeted application of cooling liquid;

providing a ring blank having a temperature in a range of 900° C. to 1150° C.;

rolling the ring blank to an outer diameter by a hot forming process;

quickly cooling down the ring in said structure by a controlled cooldown process directly following the rolling, without secondary heating, from a temperature over a conversion temperature in the austenite range to a temperature below 400° C., said controlled cooldown process comprising:

placing said ring in said reservoir of cooling liquid such that said ring is surrounded by cooling liquid;

applying an elevated pressure flow of cooling liquid to said ring via said pressure nozzles with said ring located in said reservoir of cooling liquid.

12. A method as defined in claim 11, wherein said controlled cooldown process further comprises:

transferring said ring from said reservoir of cooling liquid to an ambient environment, wherein said ring is cooled to an ambient temperature via air;

measuring a temperature of said ring with a radiation pyrometer before and/or after placing said ring in said reservoir of cooling liquid;

measuring a temperature of said cooling liquid before placing said ring in said reservoir of cooling liquid;

adjusting a cooling time based on said temperature of said ring and said temperature of said cooling liquid, wherein a plurality of dipping operations are carried out one after another.

13. A method as defined in claim 11, further comprising:

providing a carrier that can be lowered with a hoisting device;

arranging said ring on said carrier, wherein said ring is placed in said reservoir of cooling liquid by lowering said carrier into said reservoir of cooling liquid.

14. A method as defined in claim 11, wherein said nozzles are uniformly distributed along a circumferential surface of said structure, wherein a circumference of said circumferential surface of said structure corresponds to a circumference of said ring.

15. A method as defined in claim 11, wherein at least a portion of said nozzles is in contact with said reservoir of cooling liquid.

* * * * *